United States Patent [19]

Kear

[11] Patent Number: 4,470,362

[45] Date of Patent: Sep. 11, 1984

[54] THREAD SAVER CONTROL

[76] Inventor: Jerry S. Kear, P.O. Box 3463, Knoxville, Tenn. 37917

[21] Appl. No.: 540,431

[22] Filed: Oct. 11, 1983

[51] Int. Cl.[3] ..... D05B 69/08

[52] U.S. Cl. ..... 112/262.1; 112/272; 112/276; 112/DIG. 2

[58] Field of Search ..... 112/272, 273, 276, 130, 112/DIG. 2, DIG. 3, 262.1, 262.3, 262.2

[56] References Cited

U.S. PATENT DOCUMENTS

| | | | |
|---|---|---|---|
| 3,156,204 | 11/1964 | Harnish et al. | 112/276 X |
| 3,359,931 | 12/1967 | Miller et al. | 112/276 X |
| 3,389,679 | 6/1968 | Weber et al. | 112/DIG. 2 |
| 3,667,410 | 6/1972 | Bianchi | 112/276 X |
| 3,760,748 | 9/1973 | Rockerath | 112/276 |
| 3,977,339 | 8/1976 | Tice | 112/276 |
| 4,271,775 | 6/1981 | Tice | 112/276 |
| 4,280,425 | 7/1981 | Croyle | 112/272 |

*Primary Examiner*—H. Hampton Hunter

*Attorney, Agent, or Firm*—Pitts, Ruderman & Kesterson

[57] ABSTRACT

A combination stitching system including a pneumatic sensing apparatus which operates to assure the presence of a material to be stitched is in a proper location before machine operation is possible is disclosed. The combination system comprises a machine (10) for stitching or sewing a material (30) with thread (26). At least one reciprocating needle (12) receives thread (26) through an aperture (28) for stitching the material (30). A power source (20) is connected by a drive linkage (18) which includes a clutch (21) and which provides reciprocating motion to needle (12). The clutch (21) operates to selectively connect and disconnect the power source from the reciprocating needle (12) by means of an activating means (22). To assure that the reciprocating needle operates only when a work piece (30) is in a position to be stitched, there is also included a pneumatic sensing apparatus (32). Pneumatic sensing apparatus (32) includes a source of pressurized air (34) which is connected to a air gap means (38), an air jet nozzle (40), and a control valve (42). The air gap means (38) operates so that a stream of air is ejected across an open area of the air gap means such that pressurized air from source (34) is provided through the air gap means to the control valve (42). When the air pressure is provided to control valve (42), air pressure is then made available to the actuating means (22) to activate the clutch (21). Air jet nozzle (40) is located in position so that a high pressure jet of air (64) is directed to impinge upon the air stream (50) of air gap means (38).

19 Claims, 5 Drawing Figures

FIG. 1
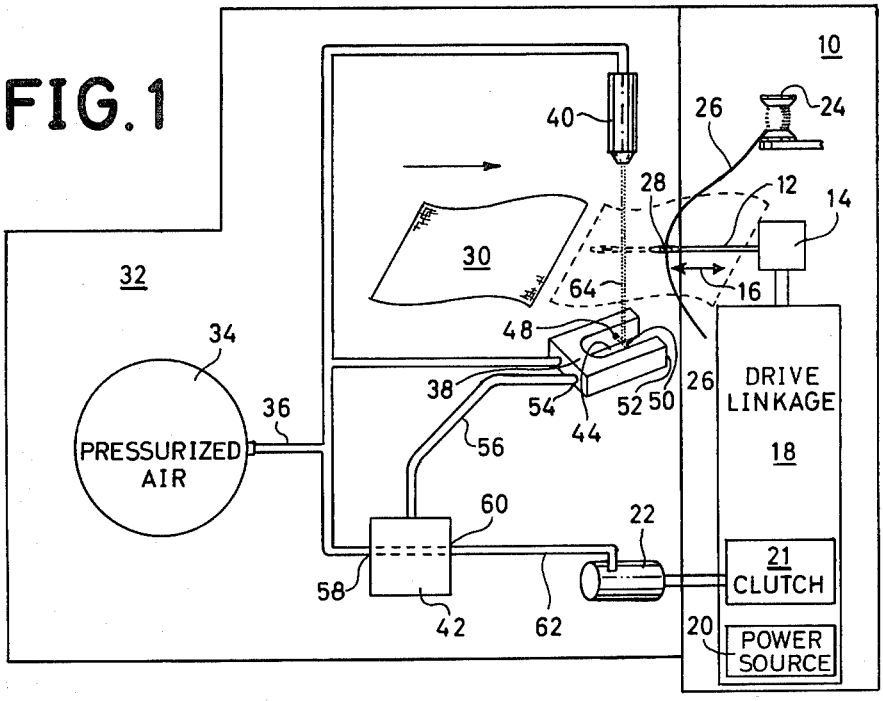
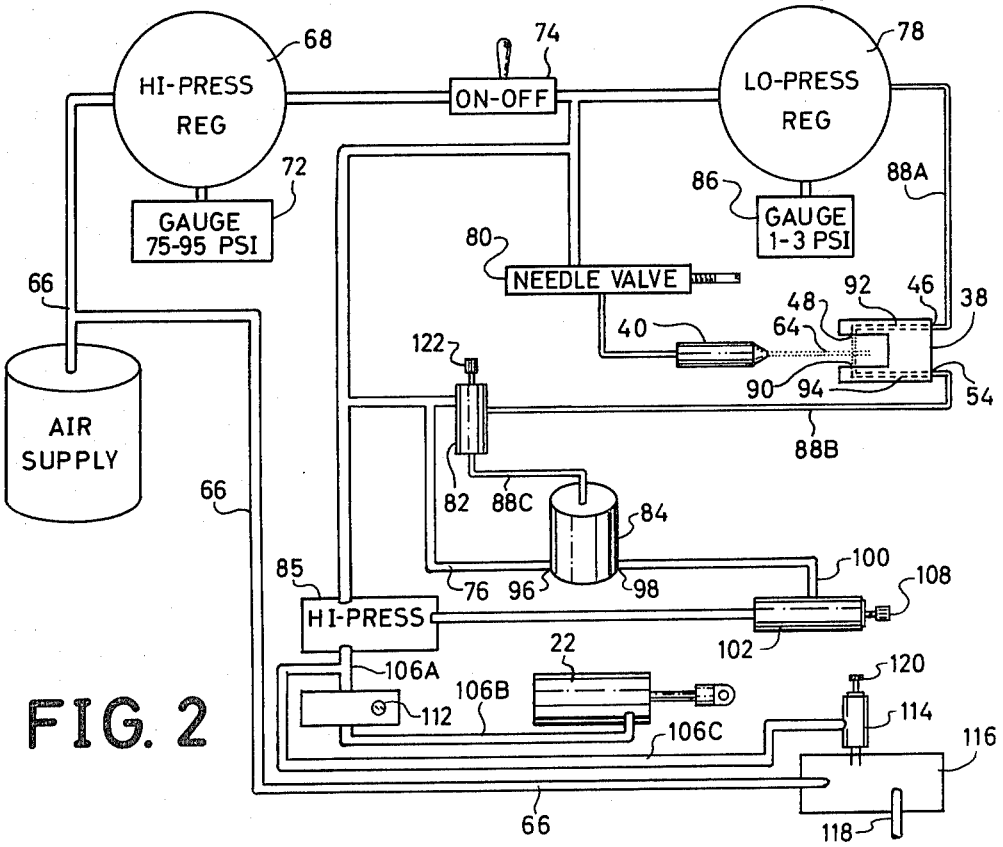
FIG. 2

THREAD SAVER CONTROL

DESCRIPTION

1. Technical Field

This invention relates to commercial sewing and stitching devices, and more particularly to pneumatically controlled apparatus for conserving the sewing thread used by the machine. The apparatus operates by sensing the presence of a material to be sewn by means of an air gap and allows operation of the system only when material to be sewn is present. In addition, in a preferred embodiment, the apparatus includes a cyclic timer such that the sensing apparatus cannot be readily overridden by an operator.

2. Background Art

It will be appreciated by those skilled in the art, over the years various types of stitching and sewing machines have been developed for use in industry. For example, there are machines which automatically position the needle for high speed operation either in the material or out of the material to save time. An example of such a machine is disclosed in U. S. Pat. No. 4,271,775 issued to William A. Tice on June 9, 1981. Another U.S. Pat. No. 3,977,339, also issued to Mr. Tice on Aug. 31, 1976, discloses still another positioning apparatus for such stitching machines. Still other patents such as U.S. Pat. No. 3,359,331 issued to R. E. Miller, et al. on Dec. 26, 1967 disclose systems that in the proper order will start and drive the sewing machine, lower the pressure foot and cut the thread. Then at the completion of the sewing of one work piece, the machine will introduce a second work piece to the sewing machine, lift the pressure foot and stop the machine, thereby continually advancing the work pieces. Still another patent issued to John R. Rockerath on Sept. 25, 1973, and having U. S. Pat. No. 3,760,748, discloses a sewing machine having a cutting mechanism and an override control mechanism. This machine positively controls the advance of material past the cutting mechanism and synchronizes the advance of the material with the operation of the cutting mechanism.

Thus, it can be seen that there have been provided in the past some very complex and automated machines for providing sewing and stitching operations. However, regardless of the needs for certain complete automatic sewing machines, there is still a need in certain industries for machines which are personnel operated. These machines often will use multiple needles and therefore require multiple sources of threads. Further, even though they are personnel operated, the personnel operating the machines are professional and extremely fast. Therefore, overrunning of the material after the sewing is completed for only a short period of time, or actually starting the machine stitching prior to the introduction of the material can waste a considerable amount of thread. Consequently, it is desirable to include a control with the machine that does not allow the machine to stitch and thereby waste thread unless a material to be stitched is in the proper position. Various systems have been developed to accomplish such a purpose. For example, U. S. Pat. No. 4,280,425 issued to Gene F. Croyle on Jul. 28, 1981, discloses an electro-pneumatic stitching sensing system. This system includes several internal interlocks that require the existence of selected conditions for continuation of normal machine operation. Unfortunately, as will be appreciated by those skilled in the art, the systems which are electro-pneumatic, that is, include light emitting and light detecting dials to sense the material, are very much subject to interference by a collection of lint which may be identified by the sensor as the actual cloth. Such a collection of lint therefore may result in the purpose of the system being overridden. In addition, such electronic systems are complex and require sophisticated maintenance if they are to continue to operate properly.

Accordingly, it is an object of the present invention to provide an improved stitching machine having a pneumatic sensing apparatus to assure the presence of a material to be stitched before operation can take place.

It is a further object of the present invention to provide a simple and inexpensive pneumatic sensing system which is not overly sensitive to the presence or the collection of lint.

It is yet another object of the present invention to provide a pneumatic sensing system for use with a stitching machine which cannot readily be overridden or ignored by the operating personnel.

DISCLOSURE OF THE INVENTION

Other objects and advantages will be obvious and will in a part appear hereinafter and will be accomplished by the present invention which provides a stitching system including pneumatic sensing apparatus operating in cooperation with a stitching machine. The sensing apparatus requires the presence of a material to be stitched before the machine will operate. The combination system of this invention comprises a machine for stitching or sewing with thread, and includes a source of thread, and at least one needle having an aperture for passing the thread therethrough. Also included is a means for supporting the needle and for providing reciprocating motion to the needle. The feeding of thread to the machine operates in cooperation and synchronization with the reciprocating needle. A power source such as an electrical or rotating motor typically provides the driving motion and power to the machine by means of a drive linkage connected between the power source or motor and the reciprocating needle and support means. This drive linkage transmits the driving motion and power to the needle as reciprocating motion and will include a clutch responsive to an actuating means such as an actuating cylinder for selectively connecting and disconnecting the power source to/from the reciprocating needle and needle support means. The pneumatic sensing apparatus itself includes a source of pressurized air which is connected by an air path to an air gap means having a body portion which defines an open area. The perimeter of the open area has an ejection side and an acceptance side and the body portion also includes a supply port connected by a supply air path to an ejection port located on the ejection side of the open area. Also included is an acceptance port located on the acceptance side of the open area. The acceptance port is connected to a discharge port by a discharge air path. This supply port and the ejection port cooperate in that the supply port receives a flow of air from the pressurized source and the ejection port ejects a stream of air across the open area towards the acceptance port. The acceptance port and the discharge port cooperate in that the acceptance port collects the stream of air from the ejecting port and, in turn, provides a flow of air to the discharge port. An actuating means which is responsive to the flow of air from the discharge port may then activate the drive linkage clutch. An air nozzle is included which is connected to the source of pressurized air and which is positioned to direct a jet of air against the stream of air traveling across the open space. The purpose of the air jet is to change the direction of the stream of air such that the stream does not reach the acceptance port. There is also included, of course, various conduit means for transporting air from the pressurized source to the nozzle and the air gap means as well as the actuating means. The nozzle and the air gap means are located at a carefully selected positon with respect to each other and proximate the reciprocating needle and needle support means. This careful positioning of the nozzle, the air gap and the needle allows operation such that when a material to be stitched or sewn is in position with respect to the reciprocating needle, the jet of air is blocked from impinging upon the stream of air. Consequently the actuating means actuates the drive linkage clutch. However, when the material is not present, the jet of air will impinge upon the stream of air thereby interrupting it and prevent the activation of the drive linkage clutch. According to a preferred embodiment, there may also be included a cyclic timer which will allow the stitching machine to operate only for a preselected amount of time each cycle. Also in the preferred embodiment, there is a timer that allows for continued stitching of the material for a short selected period of time after the material is no longer sensed by the pneumatic sensing machine. This is necessary, since in many situations the sensor may detect the end of the material before the needle has a chance to completely stitch the material.

BRIEF DESCRIPTION OF THE DRAWINGS

The above-mentioned features of the present invention will be more clearly understood from consideration of the following description in connection with the accompanying drawings in which:

FIG. 1 is a part schematic and part block diagram of the system of this invention.

FIG. 2 the preferred embodiment of the pneumatic sen portion of the combination system of FIG. 1.

BEST MODE FOR CARRYING OUT THE INVENTION

Figure 3:
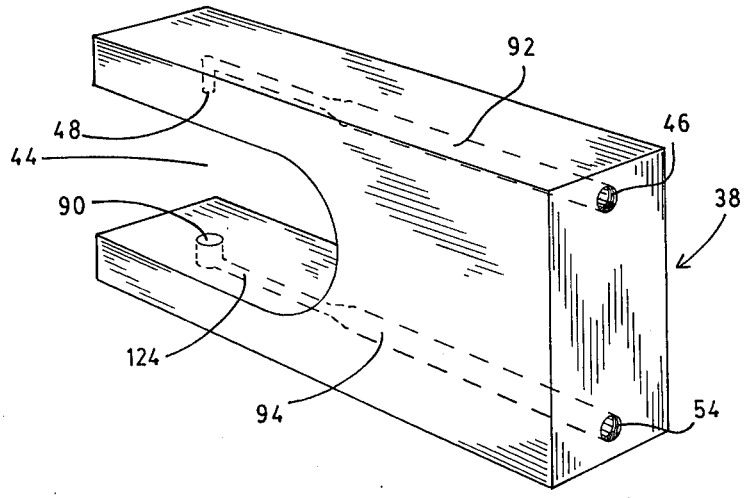
FIG. 3 shows the details of the air gap means used in FIG. 2.

Referring now to FIG. 1, there is shown a partial block diagram and partial schematic of the combination stitching or sewing system of this invention. As shown, there is included a stitching or sewing machine 10 having a needle 12 supported by a needle support means 14. Needle 12 is connected to support means 14 so as to operate in a reciprocating manner as indicated by double headed arrow 16. The reciprocating needle 12 and needle support means 14 receive driving power and motion from a drive linkage 18 which in turn is connected to a power source 20 such as for example a rotating electrical motor. Drive linkage 18 includes a clutch 21 for selectively connecting and disconnecting power source 20 from reciprocating needle 12. This is accomplished by means of an actuating means 22 to be discussed in detail hereinafter. The stitching machine 10 also includes one source 24 of thread 26. Thread 26 is made available and fed to needle 12 through aperture 28 in synchronization with the reciprocating motion of needle 12. Thus, needle 12 operates in conjunction with thread 26 to stitch or sew a material or work piece 30 as necessary. However, to assure that work piece 30 is in a position to be stitched or sewn by reciprocating needle 12 and thread 26 (proper position is indicated by dashed lines 30A) there is also included a pneumatic sensing apparatus 32. Sensing apparatus 32 is located proximate needle 12, and operates, as will be discussed in detail hereinafter, such that actuating means 22 will operate clutch 21 to transmit power from power source 20 to the needle support means 14 only when work piece 30 is in a proper position. Pneumatic sensing system 32 includes a source of pressurized air 34 for supplying an air flow by means of conduit 36 to air gap means 38, air jet nozzle 40 and a control valve 42. As shown, air gap means 38 defines an open space 44. A flow of air from source 34 passes through conduit 36 to a supply port 46 on air gap means 38. Within air gap means 38 there is included a supply air path (not shown) between supply port 46 and ejection port 48. Ejection port 48 is located on one side of the perimeter of the air gap 44 such that it directs a stream of air 50 to an acceptance port (not visible in FIG. 1) on acceptance side 52 of the open area 44. The acceptance port is connected by a collection air path (not shown) to a discharge port 54 located on air gap means 44. Thus, it will be appreciated that a flow of air will enter supply port 46, be ejected through the ejection port 48 across air gap 44, be received by acceptance port which is connected to the discharge port 54, such that there is provided a flow of air to conduit 56. Conduit 56 is itself connected to control valve 42 so that when an air flow or air pressure is available in conduit 56 air valve 42 will operate to provide a path from conduit 36 connected to port 58 to port 60 of air valve 42 such that a flow of pressurized air may be provided through conduit 62 to actuating means 22. When pressurized air is available in conduit 62, actuating means 22 will be activated such that clutch 21 of drive linkage 18 is engaged.

Also connected to conduit 36 is the air jet nozzle 40. Air jet nozzle 40 is positioned with respect to air gap means 38 so that a high pressure jet of air 64 will impinge upon the stream of air 50 crossing open area 44 of air gap means 38. The jet of air from nozzle 40 is of sufficient pressure and force to change the direction of air stream 50 such that it no longer reaches the acceptance port in air gap means 38. Thus, there will no longer be any air flow in conduit 56, and consequently control valve 42 will not be activated. Since control valve 42 is not activated, conduit 62 will not have a source of pressurized air to activate activating means 22. Thus, it can be seen that in the normal condition, the nozzle 40 will eject a jet of air 64 against the stream of air 50 to prevent the operation of the stitching or sewing machine 10. However, when the work piece 30 is in the position indicated by dashed lines 30A, the jet of air 64 is interrupted by the work piece 30 such that the jet of air 64 can no longer impinge upon the air stream 50. Consequently, the air stream 50 will be received at the acceptance port which in turn allows the operation of the actuating means 22 by air pressure in conduit 62 received from control valve 42.

Thus, it will be appreciated that only when a piece of material or work piece 30 is in a suitable position for stitching (such as indicated by dashed line 30A) by reciprocating needle 12 will actuating means 22 engage the clutch 20 and allow the machine to be operated. This, of course, means that stitching and therefore use of the thread 26 cannot occur except when a piece of material is in the proper stitching location.

Referring now to FIG. 2, there is shown a preferred embodiment of the pneumatic sensing system of this combination system. It will be appreciated, of course, that those elements of this FIG. 2 which are the same or common with those elements of the previously discussed FIG. 1 will carry the same reference numbers. In a similar manner, any elements of the remaining FIGS. 4, 5, and 6 which are also common to FIGS. 1 and 2 will also carry the same reference numbers. As shown in FIG. 2, pressurized air from source 34 is provided through a source conduit 66. As shown, one branch of source conduit 66 is provided to a high pressure regulator 68 which controls the output to supply line 70 at 75 to 95 pounds per square inch. As shown, there is a gauge 72 for determining the output of high pressure regulator 68. Connected to supply line 70 is an "on and off" switch or valve 74 to control the availability of pressurized air to the remaining portions of the pneumatic sensing system. As shown, the "on and off" valve or switch 74 is connected to pressurized air conduit 76, and includes four branches. The four branches of conduit 76 are connected to a low pressure regulator 78, a needle valve 80, a purge valve 82, and control valves, including low pressure valve 84, and a high pressure valve 85. These four branches of supply conduit 76 will be discussed hereinafter. As shown, low pressure regulator 78 receives a supply of air from pressurized air conduit 76 and includes a pressure gauge 86 such that the output in low pressure conduit 88A may be maintained between one (1) and three (3) pounds per square inch. As shown, low pressure conduit 88A is connected to a supply port 46 of air gap means 38. Air gap means 38 operates in the same manner as was discussed with respect to the air gap means of FIG. 1 and includes a discharge port 54, an ejection port 48, and an acceptance port 90. A stream of air 50 travels from the ejection port 48 and is received by the acceptance port 90. Also as shown, air gap means 38 includes a supply air path 92 connecting supply port 46 to ejection port 48. In addition, there is a collection air path 94 connecting acceptance port 90 with discharge port 54 such that the flow of air in conduit 88 is provided to supply port 38 across air gap 44 to acceptance port 90. The air then follows collection air path 94 and exits from discharge port 54 into low pressure conduit 88B. The low pressure air in conduit 88B is then (according to a preferred embodiment) provided through purge valve 82 to low pressure valve 84. The operation of purge valve 82 will be discussed hereinafter. In a normal operation, the low pressure air source in conduit 88B is provided through a normally open path through purge valve 82 to low pressure conduit 88C. Low pressure air from conduit 88C is then used to control the low pressure valve 84. Valve 84 is connected to the pressurized air conduit 76 so that a source of high pressure air is available at low pressure control 84 at port 96. The low pressure available in conduit 88C turns a cylinder in valve 84 and thereby opens a path from entry port 96 to exhaust port 98 such that the high pressure air contained in conduit 76 is now available in high pressure conduit 100. The high pressure air in high pressure air conduit 100 is then provided to an adjustable speed valve 102 prior to being passed into trapped air conduit 104 to a high pressure valve 85. When the pressure of air carried by trapped air conduit 104 reaches a preselected value, pressure valve 85 is activated such that a path exists for transmitting a flow of high pressure air control from pressurized air conduit 76 into control conduit 106A. In the embodiment shown, high pressure valve 85 is of such a type that a significantly higher pressure is required to activate the valve than is required to hold it in the activated state. Thus, valve 85 operates in connection with adjustable speed valve 102 to assure that high pressure valve 85 is activated even after air pressure has been removed from adjustable speed valve 102. In this regard, the adjustable speed valve 102 acts to trap air in trapped air conduit 104 between the valve 102 and the high pressure valve 85. When the low pressure valve 84 is activated, it will be appreciated that the flow of air through conduit 100, adjustable speed valve 102 and trapped air conduit 104 will be the high pressure air provided by the regulator 68 or between 75 to 95 pounds per square inch. This, as will be appreciated, is sufficient to activate the high pressure valve 85. However, once the air stream 50 of air gap means 38 is interrupted by a jet of air from nozzle 40, then low pressure valve 84 will close such that air pressure is no longer applied to high pressure air conduit 100, adjustable speed valve 102, and trapped air conduit 104. However, adjustable speed valve 102 acts to trap air pressure in trapped air conduit 104 such that the high pressure valve 85 remains open. If the air in trapped air conduit 104 was completely trapped, then it would be appreciated that high pressure valve 85 would be held continuously open. However, adjustable speed valve 102, by design, allows air to leak out trapped air of conduit 104 at a rate predetermined by the setting of adjusting knob 108. That is, adjusting knob 108 may be set such that a specific amount of time is required for the air pressure in trapped air conduit 104 to bleed or drop off to a low enough level that the high pressure valve 85 is allowed to close. As will be discussed hereinafter, this adjustable closing time on high pressure valve 85 allows the machine to continue stitching for a preselected amount of time after the edge of the cloth material has passed by the pneumatic sensor. The output of high pressure valve 85 to control conduit 106A is then provided to a cyclic timer 110 prior to being provided to another section of control conduit 106B which, as shown, is connected to actuating means or cylinder 22. Cyclic timer 110 operates such that air will be allowed to pass therethrough from conduit 106A to 106B only for a preselected amount of time. That is, after the preselected amount of time has expired, negative or cyclic timer 110 will act as a valve and close off any further air pressure to actuating means 22. The purpose of cyclic timer 110 as will be appreciated, is therefore to assure that the sensing circuit of nozzle 40 and air gap means 38 is not covered or otherwise overridden by an operator. Thus, the cyclic timer 110 must be reset periodically if the actuating means 22 is to cause clutch 20 to be engaged. As shown, the cyclic timer 110 may also have the amount of time adjusted by means of adjusting knob 112. It will also be appreciated, that the cyclic timer 110 is optional and may be deleted from the system such that the system will continue to operate. As shown, control conduit 106A has a second path 106C which is provided to a second adjustable speed control valve 114. The adjustable speed control valve 114 is connected between conduit 106C and a second high pressure valve 116. The adjustable speed control valve 116 operates the same as high pressure valve 85. Thus, if sufficient air pressure is provided through conduit 106 and adjustable speed control valve 114, high pressure valve 116 will operate so as to provide a path from source conduit 66. This path will carry air pressure from the source 34 through valve 116 and out conduit 118 to a venturi means (not shown) which keeps the thread chain sucked into a waste removal conduit such that the thread does not ball up behind pressure foot. However, as was discussed above, adjustable speed valve 114 operates to trap air between its discharge port and the input to high pressure valve 116 such that high pressure valve 116 remains in an open position even after pressure has been removed from conduit 106C. As was true with adjustable speed valve 102, adjustable speed valve 114 also includes a timer control knob 120 such that the amount of time that the high pressure valve 116 remains open after air pressure is removed from conduit 106C and control valve 114 may be adjusted. It will also be appreciated that in the event that the cyclic timer 110 is not used, then the conduit 106C may branch anywhere from the conduit 106A or 106B. Thus, at this point, it will be appreciated, that two of the five branches of conduit 76 have been discussed. That is, the branch to air gap means 38 and the branch to actuating means 22 have been discussed. However, needle valve 80 is also connected to pressurized air conduit 76 and is used to control the amount of air provided to air jet nozzle 40. Thus, the strength or amount of air pressure exiting from air jet nozzle 40 may be adjusted by needle valve 80. Further, as was discussed hereinabove with respect to FIG. 1, air jet nozzle 40 is positioned so as to direct a jet of air 64 against air stream 50 such that air stream 50 is moved or diverted in its direction and cannot be collected by acceptance port 90. Also as was discussed above, when a piece of material or work piece 30 is moved between the stream (as shown by dashed lines 30A) of jet 64 and stream of air 50, the air jet 64 is blocked and therefore will no longer act to divert stream 50 from being collected at acceptance port 90.

The fourth branch from pressurized air conduit 76 is provided to purge valve 82. Purge valve 82, as was discussed hereinabove, provides a normally open path from low pressure conduit 88B to conduit 88C. However, to purge the air gap means 38 or blow lint from the gap thereof, button 122 is depressed which in effect closes low pressure conduit 88C and opens an air path between pressurized air conduit 76 through purge valve 82 and into low pressure conduit 88B such that high air pressure is blown backwards through the air gap means 38 out of the acceptance port 90 and into the ejection port 48. This reverse flow of high pressure air is used to purge the air gap sensor from lint which may collect. It will be appreciated to this point, that a preferred embodiment of the pneumatic sensing apparatus of the combination system of this invention has been disclosed.

Referring now to FIG. 3, there is shown an enlarged and more detailed view of the air gap means 38. As shown, and as was discussed heretofore, low air pressure normally enters supply port 46, passes through supply air path 92, and out ejection port 48, such that an air stream 50 is directed across the air gap 44 where it is collected at acceptance port 90. The air entering acceptance port 90 is then routed into air collection path 94 and out discharge port 54. However, according to an improved air gap means, particularly suitable for operation with this invention, air path 94 includes a narrow or neck portion 124. The use of the neck portion 124 is particularly effective with the air gap means 38 during purging operations. Thus, the high pressure air which in the purging operation will be entering the discharge port 54 will be forced to pass through the narrow neck portion 124 before being injected into the receiving port 90. This increased velocity of the air flow such that the receiving port 90 and the air gap 44 is thoroughly purged of any lint that may have collected therein.

Figure 4:
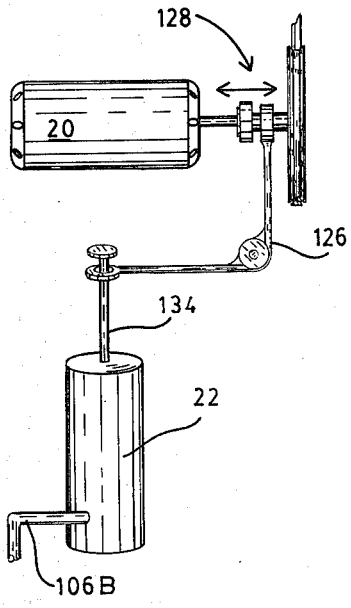
FIG. 4 discloses the clutch and clutch activating means for full automatic operation.

Referring now to FIG. 4, there is shown the typical operation of the completely automatic mode of the present invention. As shown, when actuating means 22 is activated by air pressure from conduit 106B, the lever arm 126 is actuated to engage the clutching mechanism indicated generally at 128 such that the linkage 18 between the power source 20 and the reciprocating needle 12 and needle support means 14 is engaged.

Figure 5:
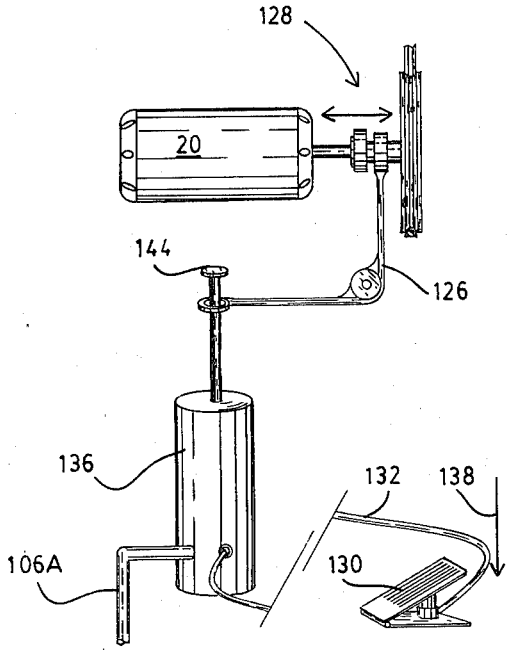
FIG. 5 discloses the clutch and clutch actuating means for semi-automatic operation requiring the use of an operator pedal.

However, as is shown in FIG. 5, it is also possible to provide semi-automatic operation such that both a foot pedal 130 connected by a linkage 132 to the cylinder must also be depressed at the same time air pressure exists on conduit 106B. According to this embodiment, the piston 134 which activates the arm 126 extends into cylinder 136 which cylinder 136 attaches to foot pedal 130 by linkage 132. When foot pedal 130 is depressed cylinder 136 will be carried or moved in the direction indicated by arrow 138. Unless the piston 134 has been activated or pulled in by air pressure movement of the cylinder 136 will simply allow the sleeve 142 surrounding piston 134 to move back and forth on piston 134. Thus, only when air pressure in conduit 106B has retracted piston 134 (such that there is no distance between sleeve 142 and the end 144 of the piston) will activation of the foot pedal 130 result in the clutch arm 126 being moved so as to activate clutch 128. Then as was the case in the previous embodiments, power from the power source 20 is provided through the clutch mechanism 128 of linkage 18 such that driving power is provided to reciprocating needle 12.

Thus although there has been described particular embodiments of the present invention of a combination sewing system using a pneumatic sensing apparatus, it is not intended that such specific references be considered as limitations upon the scope of this invention except insofar as to set forth in the following claims.

I claim:

1. A combination stitching system including pneumatic sensing apparatus operating in cooperation with a stitching machine, said pneumatic sensing apparatus requiring the presence of a material to be stitched before said stitching machine may be operated, said combination system comprising:

a machine for stitching or sewing a material with thread, said machine including;

a source of thread, at least one needle for carrying said thread into a material to be stitched and a needle support means for providing reciprocating motion to said needle, a power source for providing driving motion and power, a drive linkage connected between said power source and said needle support means for transmitting said driving motion and power from said power source to said needle as reciprocating driving motion, said drive linkage including a clutch responsive to an actuating means for selectively connecting and disconnecting said power source and said needle support means; and pneumatic sensing apparatus including, a source of pressurized air, an air gap means having a body portion defining an open area, the perimeter of said open area having an ejection side and an acceptance side, said body portion further including a supply port connected by a supply air path to an ejection port located on said ejection side of said open area and an acceptance port located on said acceptance side of said open area and connected by a discharge air path to a discharge port, said supply port and said ejection port cooperating such that said supply port receives a flow of air from said pressurized source and said ejection port ejects a stream of air across said open area towards said acceptance port, said acceptance port and said discharge port cooperating such that said acceptance port collects said stream of air from said ejecting port and provides a supply of air through said discharge air path to said discharge port, actuating means responsive to said flow of air to said discharge port for actuating said drive linkage clutch, a nozzle connected to said source of pressurized air and positioned to direct a jet of air against said stream of air traveling across said open space to change the direction of said stream such that said stream does not reach said acceptance port, and conduit means for transporting air from said pressurized source to said nozzle, and said air gap means and said actuating means, said nozzle and said air gap means being located with respect to each other and proximate said reciprocating needle and operating such that when a material is in position with respect to said reciprocating needle suitable for sewing or stitching, said jet of air is blocked from said stream of air and said actuating means actuates said drive linkage clutch, and when such a material is not present, said jet impinges upon said stream thereby interrupting said stream of air preventing the activation of said clutch.

2. The combination system of claim 1 wherein said conduit means provides pressurized air from said source to said activating means, and further including an air valve connected in said conduit responsive to a flow of air from said air gap means so as to interrupt said pressurized air from said source to said activating means when said flow of air from said air gap means is interrupted.

3. The combination system of claim 1 and further including means for adjusting the pressure of said air jet from said nozzle.

4. The combination system of claim 1 and further including a timing means located in a conduit path between said air gap means and said actuating means such that once said timing means is activated said actuating means will remain in a activated condition for a selected period of time after said air gap means determines that material to be sewn is not present.

5. The combination system of claim 2 further including a timing means connected in a conduit path between said air gap means and said valve and operating such that once activated said activating means will remain in an activated condition for a selected period of time after said air gap means has determined that material to be sewn is not present.

6. The combination system of claim 3 of further including a timing means located in a conduit path between air gap means and said actuating means and operating such that once activated said actuating means will remain in an activated condition for a selected period of time as determined by said timing means after said air gap means determines that material to be sewn is not present.

7. The combination system of claim 1 and further including a cyclic timing means connected between said air gap means and the actuating means to prevent actuation of said actuating mechanisms in less than a preselected time period after a previous activation.

8. The combination system of claim 2 and further including a cyclic timing means connected between said air gap means and the actuating means to prevent actuation of said actuating mechanisms in less than a preselected time period after a previous activation.

9. The combination system of claim 3 and further including a cyclic timing means connected between said air gap means and the actuating means to prevent actuation of said actuating mechanisms in less than a preselected time period after a previous activation.

10. The combination system of claim 4 and further including a cyclic timing means connected between said air gap means and the actuating means to prevent actuation of said actuating mechanisms in less than a preselected time period after a previous activation.

11. The combination system of claim 5 and further including a cyclic timing means connected between said air gap means and the actuating means to prevent actuation of said actuating mechanisms in less than a preselected time period after a previous activation.

12. The combination system of claim 6 and further including a cyclic timing means connected between said air gap means and the actuating means to prevent actuation of said actuating mechanisms in less than a preselected time period after a previous activation.

13. The combination system of claim 3 and further including regulator means located in a conduit path between said source and said air gap means wherein said air pressure of said source is between 75 to 95 pounds per square inch and said air to said air gap means receives air from said regulator means at between one to three pounds per square inch.

14. The combination system of claim 6 and further including regulator means located in a conduit path between said source and said air gap means wherein said pressure source is between 75 to 95 pounds per square inch and said air to said air gap receives air from said air regulator at between one to three pounds per square inch.

15. The combination system of claim 12 and further including regulator means located in a conduit path between said source and said air gap means wherein said pressure source is between 75 to 95 pounds per square inch and said air to said air gap receives air from said air regulator at between one to three pounds per square inch.

16. The combination system of claim 1 wherein said discharge air path between said acceptance port and said discharge port of said air gap means includes a reduced section or neck to facilitate purging and cleaning said air gap of collected lint.

17. The combination system of claim 1 and further including a foot pedal in cooperation with said clutch actuating means located such that said foot pedal must be operated and said air gap means must sense the presence of material at the same time before said combination system will operate.

18. The method of controlling a stitching machine by means of a pneumatic system operating in cooperation with the stitching machine wherein the presence of material to be stitched is requried before operation of said stitching machine, said method comprising the steps of:

providing a source of thread, reciprocating at least one needle for carrying said thread into a material to be stitched, providing a power source for driving motion and power, transmitting said driving motion and power from said power source to said needle for reciprocating said needle, selectively connecting and disconnecting said power source and said needle in response to an activating means, directing a stream of air across a selected air gap to provide a source of air for activating said actuating means, directing a jet of air against said stream of air traveling across said air gap to change direction of said stream of air, locating said air gap and said directed jet of air respective to each other and proximate said reciprocating needle such that said stream of air and said air jet operate so that when a material is in position with respect to said reciprocating needle and suitable for sewing, said jet of air is blocked from said stream of air and said activating means is activated, and when such a material is not present said jet impinges on said stream of air and interrupts said stream of air preventing such activation.

19. The method of claim 18 and further including the step of continuing the stitching operation for a selected period of time after said air gap determines that material to be sewn is not present.

* * * * *